US010246968B2

(12) United States Patent
Budde et al.

(10) Patent No.: US 10,246,968 B2
(45) Date of Patent: Apr. 2, 2019

(54) SURGE IMMUNE STAGE SYSTEM FOR WELLBORE TUBULAR CEMENTATION

(71) Applicant: Weatherford Netherlands, B.V., Den Helder (NL)

(72) Inventors: Marcel Budde, Vlaardingen (NL); Peter Endenburg, Strijen (NL); Ivan Andre Barannikow, Houma, LA (US)

(73) Assignee: Weatherford Netherlands, B.V., Den Helder (NL)

( * ) Notice: Subject to any disclaimer, the term of this patent is extended or adjusted under 35 U.S.C. 154(b) by 485 days.

(21) Appl. No.: 14/710,090

(22) Filed: May 12, 2015

(65) Prior Publication Data

US 2015/0330181 A1 Nov. 19, 2015

Related U.S. Application Data

(60) Provisional application No. 61/994,519, filed on May 16, 2014.

(51) Int. Cl.

| | |
|---|---|
| ***E21B 23/06*** | (2006.01) |
| ***E21B 33/14*** | (2006.01) |
| ***E21B 33/16*** | (2006.01) |
| ***E21B 34/00*** | (2006.01) |
| ***E21B 34/14*** | (2006.01) |
| ***E21B 33/127*** | (2006.01) |

(52) U.S. Cl.

CPC ..... *E21B 33/146* (2013.01); *E21B 23/06* (2013.01); *E21B 33/127* (2013.01); *E21B 33/143* (2013.01); *E21B 33/16* (2013.01); *E21B 34/14* (2013.01); *E21B 2034/007* (2013.01)

(58) Field of Classification Search

CPC ..... E21B 33/146; E21B 33/16; E21B 33/127; E21B 33/1277

See application file for complete search history.

(56) References Cited

U.S. PATENT DOCUMENTS 3,529,665 A * 9/1970 Malone ..... E21B 33/127 166/147

3,789,926 A * 2/1974 Henley ..... E21B 34/14 166/154

(Continued)

OTHER PUBLICATIONS

Schlumberger Oilfield Glossary entry for "dart", accessed Aug. 3, 2017 via www.glossary.oilfield.slb.com.*

(Continued)

*Primary Examiner* — Blake E Michener

(74) *Attorney, Agent, or Firm* — Patterson + Sheridan, LLP

(57) ABSTRACT

A method for cementing a tubular string into a wellbore includes: running the tubular string into the wellbore using a workstring having a deployment assembly; delivering an opener activator through the workstring to the deployment assembly, thereby launching an opener plug from the deployment assembly; pumping the opener activator and plug to a stage valve of the tubular string, thereby opening the stage valve; pumping cement slurry into the workstring; pumping a closer activator through the workstring behind the cement slurry, thereby launching a closer plug from the deployment assembly; and pumping the closer activator and plug to the open stage valve, thereby driving the cement slurry into an annulus between the tubular string and the wellbore and closing the stage valve.

18 Claims, 7 Drawing Sheets

(56) References Cited

U.S. PATENT DOCUMENTS 3,796,260 A * 3/1974 Bradley ..... E21B 33/16 166/153
3,915,226 A * 10/1975 Savage ..... E21B 33/035 166/153
3,948,322 A * 4/1976 Baker ..... E21B 33/127 166/154
4,333,530 A 6/1982 Armstrong
4,421,165 A * 12/1983 Szarka ..... E21B 33/127 166/151
4,487,263 A * 12/1984 Jani ..... E21B 33/16 166/154
4,624,312 A * 11/1986 McMullin ..... E21B 33/05 166/153
4,711,301 A 12/1987 Stringfellow
4,751,967 A 6/1988 Blandford et al.
4,809,776 A * 3/1989 Bradley ..... E21B 33/05 166/153
5,024,273 A * 6/1991 Coone ..... E21B 33/127 166/154
5,109,925 A * 5/1992 Stepp ..... E21B 33/127 166/154
5,314,015 A * 5/1994 Streich ..... E21B 33/127 166/154
5,413,172 A * 5/1995 Laurel ..... E21B 33/1204 166/153
5,526,878 A * 6/1996 Duell ..... E21B 33/127 166/187
5,553,667 A 9/1996 Budde et al.
5,582,253 A * 12/1996 Fraser ..... E21B 23/00 166/359
5,762,139 A * 6/1998 Sullaway ..... E21B 33/16 166/155
5,787,979 A 8/1998 Giroux et al.
5,813,457 A 9/1998 Giroux et al.
6,009,944 A 1/2000 Gudmestad
6,056,053 A 5/2000 Giroux et al.
6,244,350 B1 6/2001 Gudmestad et al.
6,269,878 B1 8/2001 Wyatt et al.
6,311,771 B1 11/2001 Gudmestad et al.
6,318,472 B1 * 11/2001 Rogers ..... E21B 23/04 166/208
6,419,015 B1 7/2002 Budde et al.
6,527,057 B2 * 3/2003 Fraser, III ..... E21B 33/16 166/156
6,578,638 B2 6/2003 Guillory et al.
6,799,638 B2 10/2004 Butterfield, Jr.
6,802,372 B2 10/2004 Budde
7,182,135 B2 2/2007 Szarka
8,327,937 B2 12/2012 Giem et al.
8,657,004 B2 * 2/2014 Zhou ..... E21B 33/146 166/122
8,789,582 B2 7/2014 Rondeau et al.
2004/0020641 A1 * 2/2004 Budde ..... E21B 34/14 166/193
2004/0104025 A1 * 6/2004 Mikolajczyk ..... E21B 33/16 166/153
2005/0006106 A1 * 1/2005 Hirth ..... E21B 43/10 166/382
2007/0261850 A1 11/2007 Giroux et al.
2013/0112410 A1 5/2013 Szarka et al.
2014/0196912 A1 7/2014 Turley et al.

OTHER PUBLICATIONS

United Kingdom Examination Report dated Apr. 11, 2017, for Application No. GB1508333.0.
Weatherford International Ltd.—"POST™ Pack-Off Stage Tool, Model 781" brochure, date unknown, 3 pages.

* cited by examiner

SURGE IMMUNE STAGE SYSTEM FOR WELLBORE TUBULAR CEMENTATION

BACKGROUND OF THE DISCLOSURE

Field of the Disclosure

The present disclosure generally relates to a surge immune stage system for wellbore tubular cementation.

Description of the Related Art

A wellbore is formed to access hydrocarbon bearing formations, such as crude oil and/or natural gas, by the use of drilling. Drilling is accomplished by utilizing a drill bit that is mounted on the end of a drill string. To drill within the wellbore to a predetermined depth, the drill string is often rotated by a top drive or rotary table on a surface platform or rig, and/or by a downhole motor mounted towards the lower end of the drill string. After drilling to a predetermined depth, the drill string and drill bit are removed and a casing string is lowered into the wellbore. An annulus is thus formed between the string of casing and the wellbore. The casing string is cemented into the wellbore by circulating cement slurry into the annulus. The combination of cement and casing strengthens the wellbore and facilitates the isolation of certain formations behind the casing for the production of hydrocarbons.

Currently, cement flows into the annulus from the bottom of the casing. Due to weak formations or long strings of casing, cementing from the top of the casing may be undesirable or ineffective. When circulating cement into the annulus from the bottom of the casing, problems may be encountered as the cement on the outside of the annulus rises. For example, if a weak earth formation exists, it will not support the cement. As a result, the cement will flow into the formation rather than up the casing annulus.

To alleviate these issues, stage collars have been employed for casing cementing operations. For subterranean vertical wellbores, a free fall cone is used to open the stage collar. However, the free fall cone is unsuitable for deviated and subsea wellbores. For subsea and deviated wellbores, the stage collar has a pressure operated piston for opening thereof. Such a hydraulically operated stage tool is susceptible to premature activation due to pressure spikes in the bore of the casing string which could have catastrophic consequences.

SUMMARY OF THE DISCLOSURE

The present disclosure generally relates to a surge immune stage system for wellbore tubular cementation. In one embodiment, a method for cementing a tubular string into a wellbore includes: running the tubular string into the wellbore using a workstring having a deployment assembly; delivering an opener activator through the workstring to the deployment assembly, thereby launching an opener plug from the deployment assembly; pumping the opener activator and plug to a stage valve of the tubular string, thereby opening the stage valve; pumping cement slurry into the workstring; pumping a closer activator through the workstring behind the cement slurry, thereby launching a closer plug from the deployment assembly; and pumping the closer activator and plug to the open stage valve, thereby driving the cement slurry into an annulus between the tubular string and the wellbore and closing the stage valve.

In another embodiment, a system for cementing a tubular string into a wellbore includes: a stage valve for assembly as part of the tubular string and having: a housing, a stage port formed through the housing, a sleeve, a stage port formed through the sleeve, an opener seat connected to the sleeve, and a closer seat linked to the sleeve; and a plug release system for operating the stage valve. The plug release system includes: a closer plug having: a body, a finned seal, a latch sleeve, a lock sleeve for releasing the latch sleeve, and a landing shoulder for engaging the closer seat; and an opener plug having: a body, a finned seal, a latch sleeve, a lock sleeve for releasing the latch sleeve, and a landing shoulder for engaging the opener seat. The system further includes: a closer activator for engaging the closer lock sleeve; and an opener activator for engaging the opener lock sleeve.

BRIEF DESCRIPTION OF THE DRAWINGS

So that the manner in which the above recited features of the present disclosure can be understood in detail, a more particular description of the disclosure, briefly summarized above, may be had by reference to embodiments, some of which are illustrated in the appended drawings. It is to be noted, however, that the appended drawings illustrate only typical embodiments of this disclosure and are therefore not to be considered limiting of its scope, for the disclosure may admit to other equally effective embodiments.

DETAILED DESCRIPTION

Figure 1A:
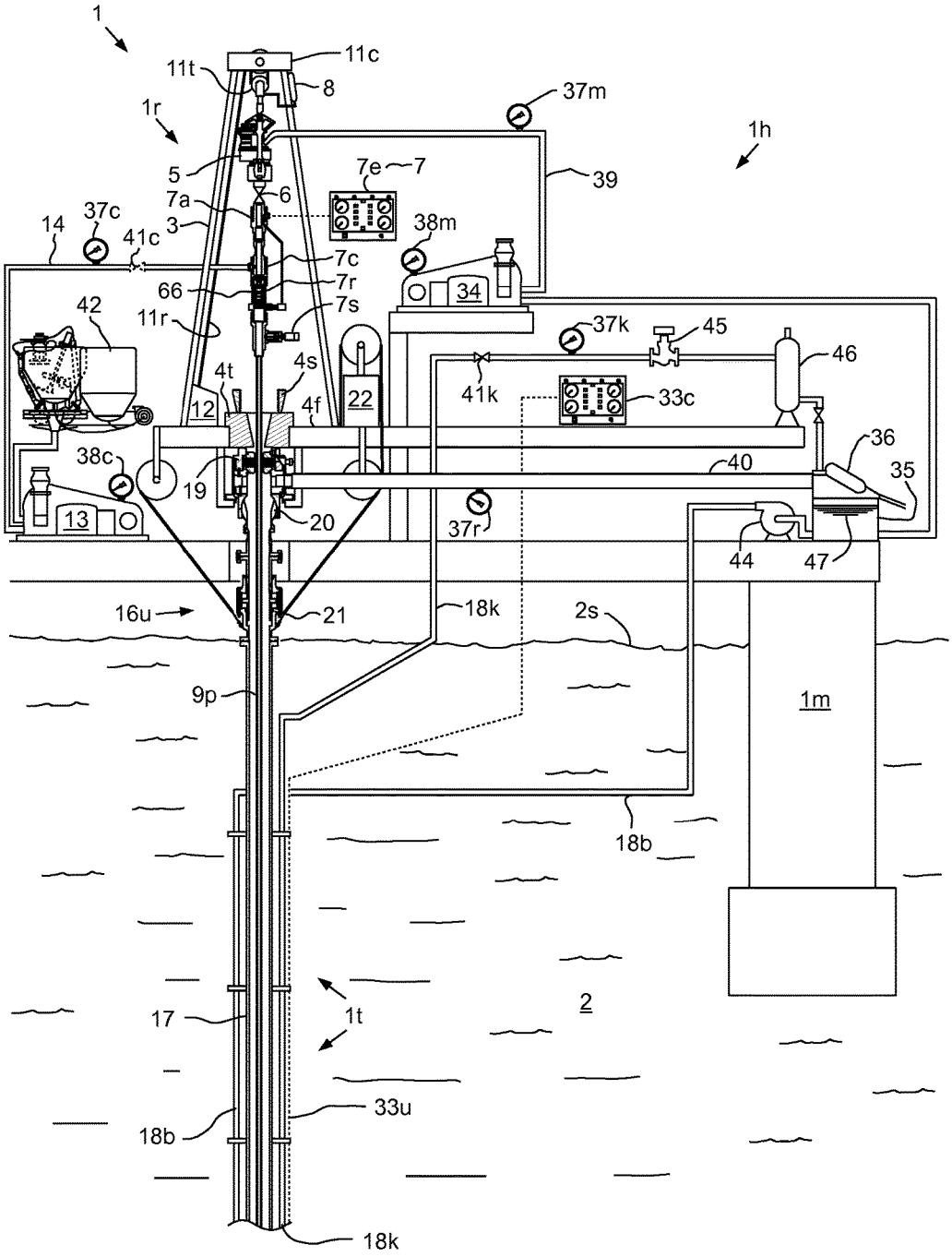
FIGS. 1A-1C illustrate a drilling system in a cementing mode, according to one embodiment of this disclosure.
Figure 1B:
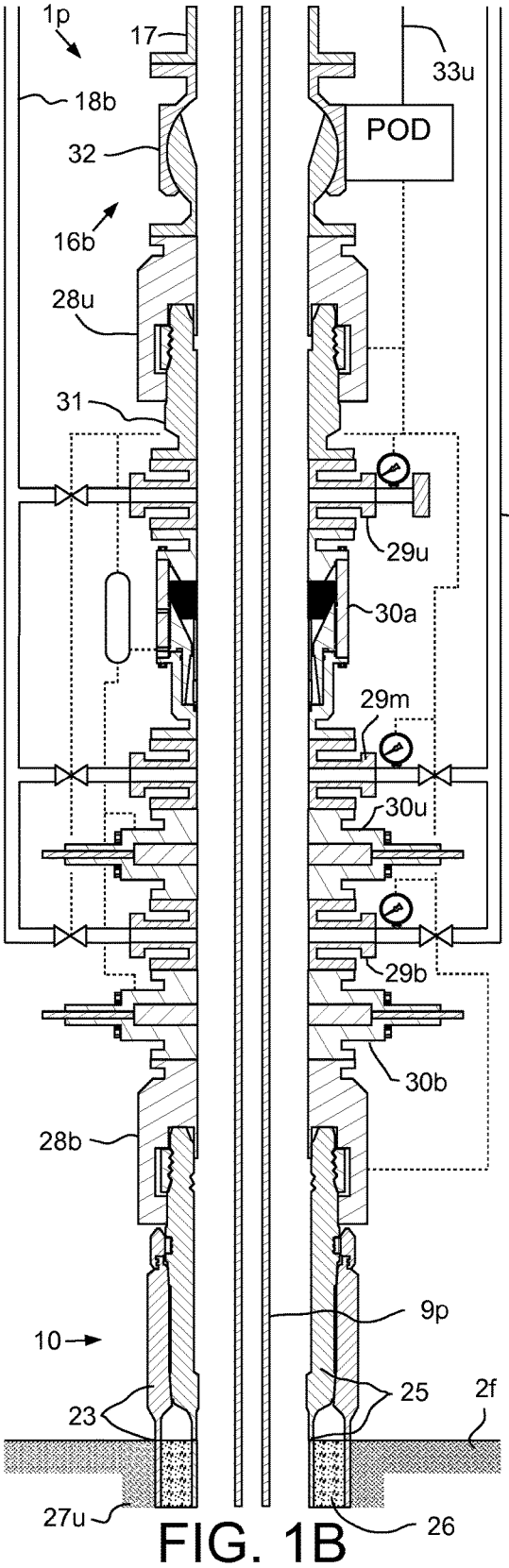
Figure 1C:
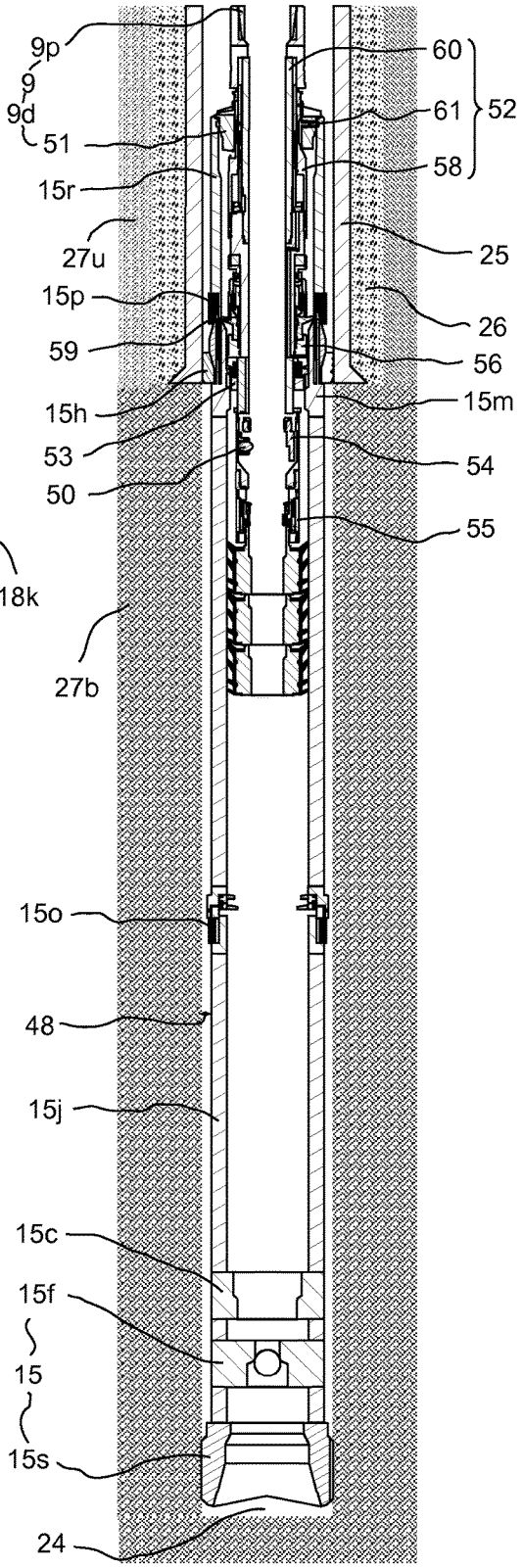

FIGS. 1A-1C illustrate a drilling system 1 in a cementing mode, according to one embodiment of this disclosure. The drilling system 1 may include a mobile offshore drilling unit (MODU) 1*m*, such as a semi-submersible, a drilling rig 1*r*, a fluid handling system 1*h*, a fluid transport system it, a pressure control assembly (PCA) 1*p*, and a workstring 9.

The MODU 1*m* may carry the drilling rig 1*r* and the fluid handling system 1*h* aboard and may include a moon pool, through which drilling operations are conducted. The semi-submersible MODU 1*m* may include a lower barge hull which floats below a surface (aka waterline) 2*s* of sea 2 and is, therefore, less subject to surface wave action. Stability columns (only one shown) may be mounted on the lower barge hull for supporting an upper hull above the waterline 2*s*. The upper hull may have one or more decks for carrying the drilling rig 1*r* and fluid handling system 1*h*. The MODU 1*m* may further have a dynamic positioning system (DPS) (not shown) or be moored for maintaining the moon pool in position over a subsea wellhead 10.

Alternatively, the MODU may be a drill ship. Alternatively, a fixed offshore drilling unit or a non-mobile floating offshore drilling unit may be used instead of the MODU. Alternatively, the wellbore may be subsea having a wellhead located adjacent to the waterline and the drilling rig may be a located on a platform adjacent the wellhead. Alternatively, the wellbore may be subterranean and the drilling rig located on a terrestrial pad.

The drilling rig 1*r* may include a derrick 3, a floor 4*f*, a rotary table 4*t*, a spider 4*s*, a top drive 5, a cementing head 7, and a hoist. The top drive 5 may include a motor for rotating 49 (FIG. 5A) the workstring 9. The top drive motor may be electric or hydraulic. A frame of the top drive 5 may be linked to a rail (not shown) of the derrick 3 for preventing rotation thereof during rotation 49 of the workstring 9 and allowing for vertical movement of the top drive with a traveling block 11*t* of the hoist. The top drive frame may be suspended from the traveling block 11*t* by a drill string compensator 8. The quill may be torsionally driven by the top drive motor and supported from the frame by bearings. The top drive 5 may further have an inlet connected to the frame and in fluid communication with the quill. The traveling block 11*t* may be supported by wire rope 11*r* connected at its upper end to a crown block 11*c*. The wire rope 11*r* may be woven through sheaves of the blocks 11*c,t* and extend to drawworks 12 for reeling thereof, thereby raising or lowering the traveling block 11*t* relative to the derrick 3.

The drill string compensator may 8 may alleviate the effects of heave on the workstring 9 when suspended from the top drive 5. The drill string compensator 8 may be active, passive, or a combination system including both an active and passive compensator.

Alternatively, the drill string compensator 8 may be disposed between the crown block 11*c* and the derrick 3. Alternatively, a Kelly and rotary table may be used instead of the top drive 5.

When the drilling system 1 is in a deployment mode (not shown), an upper end of the workstring 9 may be connected to the top drive quill, such as by threaded couplings. The workstring 9 may include a liner deployment assembly (LDA) 9*d* and a work stem, such as such as joints of drill pipe 9*p* connected together, such as by threaded couplings. An upper end of the LDA 9*d* may be connected a lower end of the drill pipe 9*p*, such as by threaded couplings. The LDA 9*d* may also be connected to a liner string 15. The liner string 15 may include a polished bore receptacle (PBR) 15*r*, a packer 15*p*, a liner hanger 15*h*, a mandrel 15*m* for carrying the hanger and packer, joints 15*j* of liner, a packing stage collar 15*o*, a landing collar 15*c*, a float collar 15*f*, and a reamer shoe 15*s*. The mandrel 15*m*, liner joints 15*j*, collars 15*c,o,f* and reamer shoe 15*s* may be interconnected, such as by threaded couplings.

The fluid transport system it may include an upper marine riser package (UMRP) 16*u*, a marine riser 17, a booster line 18*b*, and a choke line 18*k*. The riser 17 may extend from the PCA 1*p* to the MODU 1*m* and may connect to the MODU via the UMRP 16*u*. The UMRP 16*u* may include a diverter 19, a flex joint 20, a slip (aka telescopic) joint 21, and a tensioner 22. The slip joint 21 may include an outer barrel connected to an upper end of the riser 17, such as by a flanged connection, and an inner barrel connected to the flex joint 20, such as by a flanged connection. The outer barrel may also be connected to the tensioner 22, such as by a tensioner ring.

The flex joint 20 may also connect to the diverter 19, such as by a flanged connection. The diverter 19 may also be connected to the rig floor 4*f*, such as by a bracket. The slip joint 21 may be operable to extend and retract in response to heave of the MODU 1*m* relative to the riser 17 while the tensioner 22 may reel wire rope in response to the heave, thereby supporting the riser 17 from the MODU 1*m* while accommodating the heave. The riser 17 may have one or more buoyancy modules (not shown) disposed therealong to reduce load on the tensioner 22.

The PCA 1*p* may be connected to the wellhead 10 located adjacent to a floor 2*f* of the sea 2. A conductor string 23 may be driven into the seafloor 2*f*. The conductor string 23 may include a housing and joints of conductor pipe connected together, such as by threaded couplings. Once the conductor string 23 has been set, a subsea wellbore 24 may be drilled into the seafloor 2*f* and a casing string 25 may be deployed into the wellbore. The casing string 25 may include a wellhead housing and joints of casing connected together, such as by threaded couplings. The wellhead housing may land in the conductor housing during deployment of the casing string 25. The casing string 25 may be cemented 26 into the wellbore 24. The casing string 25 may extend to a depth adjacent a bottom of the upper formation 27*u*. The wellbore 24 may then be extended into the lower formation 27*b* using a drill string (not shown).

The upper formation 27*u* may be non-productive and a lower formation 27*b* may be a hydrocarbon-bearing reservoir. Alternatively, the lower formation 27*b* may be non-productive (e.g., a depleted zone), environmentally sensitive, such as an aquifer, or unstable.

The PCA 1*p* may include a wellhead adapter 28*b*, one or more flow crosses 29*u,m,b*, one or more blow out preventers (BOPs) 30*a,u,b*, a lower marine riser package (LMRP) 16*b*, one or more accumulators, and a receiver 31. The LMRP 16*b* may include a control pod, a flex joint 32, and a connector 28*u*. The wellhead adapter 28*b*, flow crosses 29*u,m,b*, BOPs 30*a,u,b*, receiver 31, connector 28*u*, and flex joint 32, may each include a housing having a longitudinal bore therethrough and may each be connected, such as by flanges, such that a continuous bore is maintained therethrough. The flex joints 21, 32 may accommodate respective horizontal and/or rotational (aka pitch and roll) movement of the MODU 1*m* relative to the riser 17 and the riser relative to the PCA 1*p*.

Each of the connector 28*u* and wellhead adapter 28*b* may include one or more fasteners, such as dogs, for fastening the LMRP 16*b* to the BOPs 30*a,u,b* and the PCA 1*p* to an external profile of the wellhead housing, respectively. Each of the connector 28*u* and wellhead adapter 28*b* may further include a seal sleeve for engaging an internal profile of the respective receiver 31 and wellhead housing. Each of the connector 28*u* and wellhead adapter 28*b* may be in electric or hydraulic communication with the control pod and/or further include an electric or hydraulic actuator and an interface, such as a hot stab, so that a remotely operated subsea vehicle (ROV) (not shown) may operate the actuator for engaging the dogs with the external profile.

The LMRP 16*b* may receive a lower end of the riser 17 and connect the riser to the PCA 1*p*. The control pod may be in electric, hydraulic, and/or optical communication with a control console 33*c* onboard the MODU 1*m* via an umbilical 33*u*. The control pod may include one or more control valves (not shown) in communication with the BOPs 30*a,u,b* for operation thereof. Each control valve may include an electric or hydraulic actuator in communication with the umbilical 33*u*. The umbilical 33*u* may include one or more hydraulic and/or electric control conduit/cables for the actuators. The accumulators may store pressurized hydraulic fluid for operating the BOPs 30*a,u,b*. Additionally, the accumulators may be used for operating one or more of the other components of the PCA 1*p*. The control pod may further include control valves for operating the other functions of the PCA 1*p*. The control console 33*c* may operate the PCA 1*p* via the umbilical 33*u* and the control pod.

A lower end of the booster line 18*b* may be connected to a branch of the flow cross 29*u* by a shutoff valve. A booster manifold may also connect to the booster line lower end and have a prong connected to a respective branch of each flow cross 29*m,b*. Shutoff valves may be disposed in respective prongs of the booster manifold. Alternatively, a separate kill line (not shown) may be connected to the branches of the flow crosses 29*m,b* instead of the booster manifold. An upper end of the booster line 18*b* may be connected to an outlet of a booster pump 44. A lower end of the choke line 18*k* may have prongs connected to respective second branches of the flow crosses 29*m,b*. Shutoff valves may be disposed in respective prongs of the choke line lower end. An upper end of the choke line 18*k* may be connected to an inlet of a mud gas separator (MGS) 46.

A pressure sensor may be connected to a second branch of the upper flow cross 29*u*. Pressure sensors may also be connected to the choke line prongs between respective shutoff valves and respective flow cross second branches. Each pressure sensor may be in data communication with the control pod. The lines 18*b,c* and umbilical 33*u* may extend between the MODU 1*m* and the PCA 1*p* by being fastened to brackets disposed along the riser 17. Each shutoff valve may be automated and have a hydraulic actuator (not shown) operable by the control pod.

Alternatively, the umbilical 33*u* may be extended between the MODU 1*m* and the PCA 1*p* independently of the riser 17. Alternatively, the shutoff valve actuators may be electrical or pneumatic.

The fluid handling system 1*h* may include one or more pumps, such as a cement pump 13, a mud pump 34, and the booster pump 44, a reservoir, such as a tank 35, a solids separator, such as a shale shaker 36, one or more pressure gauges 37*c,k,m,r*, one or more stroke counters 38*c,m*, one or more flow lines, such as cement line 14, mud line 39, and return line 40, one or more shutoff valves 41*c,k*, a cement mixer 42, a well control (WC) choke 45, and the MGS 46. When the drilling system 1 is in a drilling mode (not shown) and the deployment mode, the tank 35 may be filled with drilling fluid (not shown). In the cementing mode, the tank 35 may be filled with chaser fluid 47. A booster supply line may be connected to an outlet of the mud tank 35 and an inlet of the booster pump 44. The choke shutoff valve 41*k*, the choke pressure gauge 37*k*, and the WC choke 45 may be assembled as part of the upper portion of the choke line 18*k*.

A first end of the return line 40 may be connected to the diverter outlet and a second end of the return line may be connected to an inlet of the shaker 36. The returns pressure gauge 37*r* may be assembled as part of the return line 40. A lower end of the mud line 39 may be connected to an outlet of the mud pump 34 and an upper end of the mud line may be connected to the top drive inlet. The mud pressure gauge 37*m* may be assembled as part of the mud line 39. An upper end of the cement line 14 may be connected to a cementing swivel 7*c* and a lower end of the cement line may be connected to an outlet of the cement pump 13. The cement shutoff valve 41*c* and the cement pressure gauge 37*c* may be assembled as part of the cement line 14. A lower end of a mud supply line may be connected to an outlet of the mud tank 35 and an upper end of the mud supply line may be connected to an inlet of the mud pump 34. An upper end of a cement supply line may be connected to an outlet of the cement mixer 42 and a lower end of the cement supply line may be connected to an inlet of the cement pump 13.

During deployment of the liner string 15, the workstring 9 may be lowered by the traveling block 11*t* and the drilling fluid may be pumped into the workstring bore by the mud pump 34 via the mud line 39 and top drive 5. The drilling fluid may flow down the workstring bore and the liner string bore and be discharged by the reamer shoe 15*s* into an annulus 48 formed between the liner string 15 and the wellbore 24/casing string 25. The drilling fluid may flow up the annulus 48 and exit the wellbore 24 and flow into an annulus formed between the riser 17 and the workstring 9 via an annulus of the LMRP 16*b*, BOP stack, and wellhead 10. The drilling fluid may exit the riser annulus and enter the return line 40 via an annulus of the UMRP 16*u* and the diverter 19. The drilling fluid may flow through the return line 40 and into the shale shaker inlet. The drilling fluid may be processed by the shale shaker 36 to remove any particulates therefrom.

The float collar 15*c* may include a housing, a check valve, and a body. The body and check valve may be made from drillable materials. The check valve may include a seat, a poppet disposed within the seat, a seal disposed around the poppet and adapted to contact an inner surface of the seat to close the body bore, and a rib. The poppet may have a head portion and a stem portion. The rib may support a stem portion of the poppet. A spring may be disposed around the stem portion and may bias the poppet against the seat to facilitate sealing. During deployment of the liner string 15, the drilling fluid may be pumped down at a sufficient pressure to overcome the bias of the spring, actuating the poppet downward to allow drilling fluid to flow through the bore of the body and into the annulus 48.

The workstring 9 may be lowered until the liner string 15 reaches a desired deployment depth, such as the liner hanger 15*h* being adjacent to a lower portion of the casing string 25. The workstring 9 may be disconnected from the top drive 5 and the cementing head 7 may be inserted and connected between the top drive 5 and the workstring 9. The cementing head 7 may include an isolation valve 6, an actuator swivel 7*a*, the cementing swivel 7*c*, a release plug launcher 7*r*, a control console 7*e*, and a setting plug launcher 7*s*. The isolation valve 6 may be connected to a quill of the top drive 5 and an upper end of the actuator swivel 7*a*, such as by threaded couplings. An upper end of the workstring 9 may be connected to the setting plug launcher 7*s*, such as by threaded couplings.

The cementing swivel 7*c* may include a housing torsionally connected to the derrick 3, such as by bars, wire rope, or a bracket (not shown). The torsional connection may accommodate longitudinal movement of the cementing swivel 7*c* relative to the derrick 3. The cementing swivel 7*c* may further include a mandrel and bearings for supporting the housing from the mandrel while accommodating rotation of the mandrel. An upper end of the mandrel may be connected to a lower end of the actuator swivel 7*a*, such as by threaded couplings. The cementing swivel 7*c* may further include an inlet formed through a wall of the housing and in fluid communication with a port formed through the mandrel and a seal assembly for isolating the inlet-port communication. The mandrel port may provide fluid communication between a bore of the cementing head 7 and the housing inlet.

The actuator swivel 7*a* may be similar to the cementing swivel 7*c* except that the housing thereof may have an inlet in fluid communication with a passage formed through the mandrel thereof. The mandrel passage may extend to an outlet for connection to a hydraulic conduit for operating a hydraulic actuator of the release plug launcher 7*r*. The actuator swivel inlet may be in fluid communication with a hydraulic power unit (HPU, not shown) operated by the control console 7*e*.

The release plug launcher 7*r* may include a body, a deflector, a canister, a gate, and the actuator. The body may be tubular and may have a bore therethrough. An upper end of the body may be connected to a lower end of the cementing swivel 7*c*, such as by threaded couplings, and a lower end of the body may be connected to the setting plug launcher 7*s*, such as by threaded couplings. The canister and deflector may each be disposed in the body bore. The deflector may be connected to the cementing swivel mandrel, such as by threaded couplings. The canister may be longitudinally movable relative to the body. The canister may be tubular and have ribs formed along and around an outer surface thereof. Bypass passages (only one shown) may be formed between the ribs. Each canister may further have a landing shoulder formed in a lower end thereof for receipt by a landing shoulder of the setting plug launcher 7*s*. The deflector may be operable to divert fluid received from the cement line 14 away from a bore of the canister and toward the bypass passages. A release plug, such as a shutoff dart 66, may be disposed in the canister bore.

The gate may include a housing, a plunger, and a shaft. The housing may be connected to a respective lug formed in an outer surface of the body, such as by threaded couplings. The plunger may be longitudinally movable relative to the housing and radially movable relative to the body between a capture position and a release position. The plunger may be moved between the positions by a linkage, such as a jackscrew, with the shaft. Each shaft may be longitudinally connected to and rotatable relative to the housing. Each actuator may be a hydraulic motor operable to rotate the shaft relative to the housing. The actuator may include a reservoir (not shown) for receiving the spent hydraulic fluid or the cementing head 7 may include a second actuator swivel and hydraulic conduit (not shown) for returning the spent hydraulic fluid to the HPU.

In operation, when it is desired to launch the shutoff dart 66, the console 7*e* may be operated to supply hydraulic fluid to the launcher actuator via the actuator swivel 7*a*. The launcher actuator may then move the plunger to the release position. The canister and dart may then move downward relative to the body until the landing shoulders engage. Engagement of the landing shoulders may close the canister bypass passages, thereby forcing chaser fluid 47 to flow into the canister bore. The chaser fluid 47 may then propel the dart 66 from the canister bore into a bore of the setting plug launcher 7*s* and onward through the workstring 9.

The setting plug launcher 7*s* may include a mandrel, a body, a plunger, an actuator. During deployment of the liner string 15, a setting plug, such as a ball 50 (FIG. 1C), may be loaded therein. The launcher body may be connected to the mandrel, such as by threaded couplings. The ball 50 may be disposed in the plunger for selective release and pumping downhole through the drill pipe 9*p* to the LDA 9*d*. The plunger may be movable relative to the launcher body between a capture position and a release position. The plunger may be moved between the positions by the actuator. The actuator may be manual, such as a handwheel.

Alternatively, the actuator swivel 7*a* and release plug launcher actuator may be pneumatic or electric. Alternatively, the release plug launcher actuator may be linear, such as a piston and cylinder. Alternatively, the release plug launcher 7*r* may include a main body having a main bore and a parallel side bore, with both bores being machined integral to the main body. The dart may be loaded into the main bore, and a dart releaser valve may be provided below the dart to maintain it in the capture position. The dart releaser valve may be side-mounted externally and extend through the main body. A port in the dart releaser valve may provide fluid communication between the main bore and the side bore. In a bypass position, the dart may be maintained in the main bore with the dart releaser valve closed. Fluid may flow through the side bore and into the main bore below the dart via the fluid communication port in the dart releaser valve. To release the dart, the dart releaser valve may be turned, such as by ninety degrees, thereby closing the side bore and opening the main bore through the dart releaser valve. The chaser fluid 47 may then enter the main bore behind the dart, causing it to drop downhole.

The LDA 9*d* may include a setting tool 52, a running tool 53, a catcher 54, and a plug release system 55. The setting tool 52 may include a debris barrier 51, a packoff 56, a hanger actuator 58, a packer actuator 59, a mandrel 60, and a latch 61. An upper end of the setting tool 52 may be connected to a lower end the drill pipe 9*p*, such as by threaded couplings. A lower end of the setting tool 52 may be fastened to an upper end of the running tool 53. The running tool 53 may also be fastened to the liner mandrel 15*m*. An upper end of the catcher 54 may be connected to a lower end of the running tool 53 and a lower end of the catcher may be connected to an upper end of the plug release system 55, such as by threaded couplings.

The debris barrier 51 may be engaged with and close an upper end of the PBR 15*r*, thereby forming an upper end of a buffer chamber. A lower end of the buffer chamber may be formed by a sealed interface between the packoff 56 and the PBR 15*r*. The buffer chamber may be filled with a buffer fluid (not shown), such as fresh water, refined/synthetic oil, or other liquid. The buffer chamber may prevent infiltration of debris from the wellbore 24 from obstructing operation of the LDA 9*d*.

The hanger actuator 58 may include a piston, one or more sleeves, and a cylinder. The latch 61 may releasably connect the piston to the debris barrier 51 and the debris barrier to the PBR 15*r*. The actuator sleeves and piston may interconnected, such as by threaded couplings and/or fasteners. The actuator sleeves and piston may be disposed around and extend along an outer surface of the mandrel 60. The actuator sleeves may also be torsionally connected to the mandrel 60, such as by a pin and slot linkage. An actuation chamber may be formed between mandrel 60 and the cylinder. A foot of the piston may be disposed in the actuation chamber and may divide the chamber into an upper portion and a lower portion. The actuation chamber upper portion may be in fluid communication with the mandrel bore via an actuation port formed through a wall of the mandrel 60.

The piston and sleeves of the hanger actuator 58 may be longitudinally movable relative to the cylinder between an upper position (not shown) and a lower position (FIG. 1C) in response to a pressure differential between an upper face of the foot and a lower face of the foot. The piston and sleeves may set the liner hanger 15*h* when moving from the upper position to the lower position. The chamber lower portion may be in fluid communication with a surge chamber via a bypass passage and a bypass port of the running tool 53. The surge chamber may be formed radially between a lower portion of the LDA 9*d* (below the packoff 56) and the liner string 15 and longitudinally between the packoff 56 and a closer plug 65 (FIG. 2) of the plug release system 55.

The running tool 53 may include a body, a lock, a clutch, and a latch. The running tool latch may longitudinally and torsionally connect the liner mandrel 15*m* to an upper portion of the LDA 9*d*. The latch may include a thrust cap, a longitudinal fastener, such as a floating nut, and a biasing member, such as a lower compression spring. The running tool lock may include one or more actuation ports formed through a wall of the body, a piston, a plug, a fastener, such as a dog, and a sleeve.

The packer actuator 59 may be longitudinally connected to the mandrel by entrapment between a load shoulder of the mandrel 60 and a top of the running tool 53. The packer actuator 59 may include the packoff 56, a plurality of fasteners, such as dogs, a cam, one or more retainers, a thrust bearing, one or more radial bearings, and one or more biasing members, such as compression springs. The dogs may be restrained in a retracted position against the compression springs by engagement with an inner surface of the liner mandrel 15*m*.

The catcher 54 may be a mechanical ball seat including a body and a seat fastened to the body, such as by one or more shearable fasteners. The seat may also be linked to the body by a cam and follower. Once the ball 50 is caught, the seat may be released from the body by a threshold pressure exerted on the ball. The threshold pressure may be greater than a pressure required to set the liner hanger 15*h*, unlock the running tool 53, and release the latch 61. Once the seated ball 50 has been released, the seat and ball may swing relative to the body into a capture chamber, thereby reopening the LDA bore.

As the liner string 15 is being advanced into the wellbore 24 by the workstring 9, resultant surge pressure of the drilling fluid may be communicated to the surge chamber via leakage through the directional seals of plugs 63-65. The surge pressure may then be communicated to the lower face of the actuator piston via the running tool bypass port and the bypass passage. The surge pressure may also be communicated to an upper face of the running tool piston exposed to the surge chamber. This communication of the surge pressure to the lower face of the actuator piston and the upper face of the running tool piston may negate tendency of the surge pressure communicated to an upper face of the actuator piston by the actuation port and to the lower face of the running tool piston by the running tool actuator ports from prematurely setting the liner hanger 15*h* and prematurely unlocking the running tool 53.

Figures 5A, 5B, 5C, 5D:
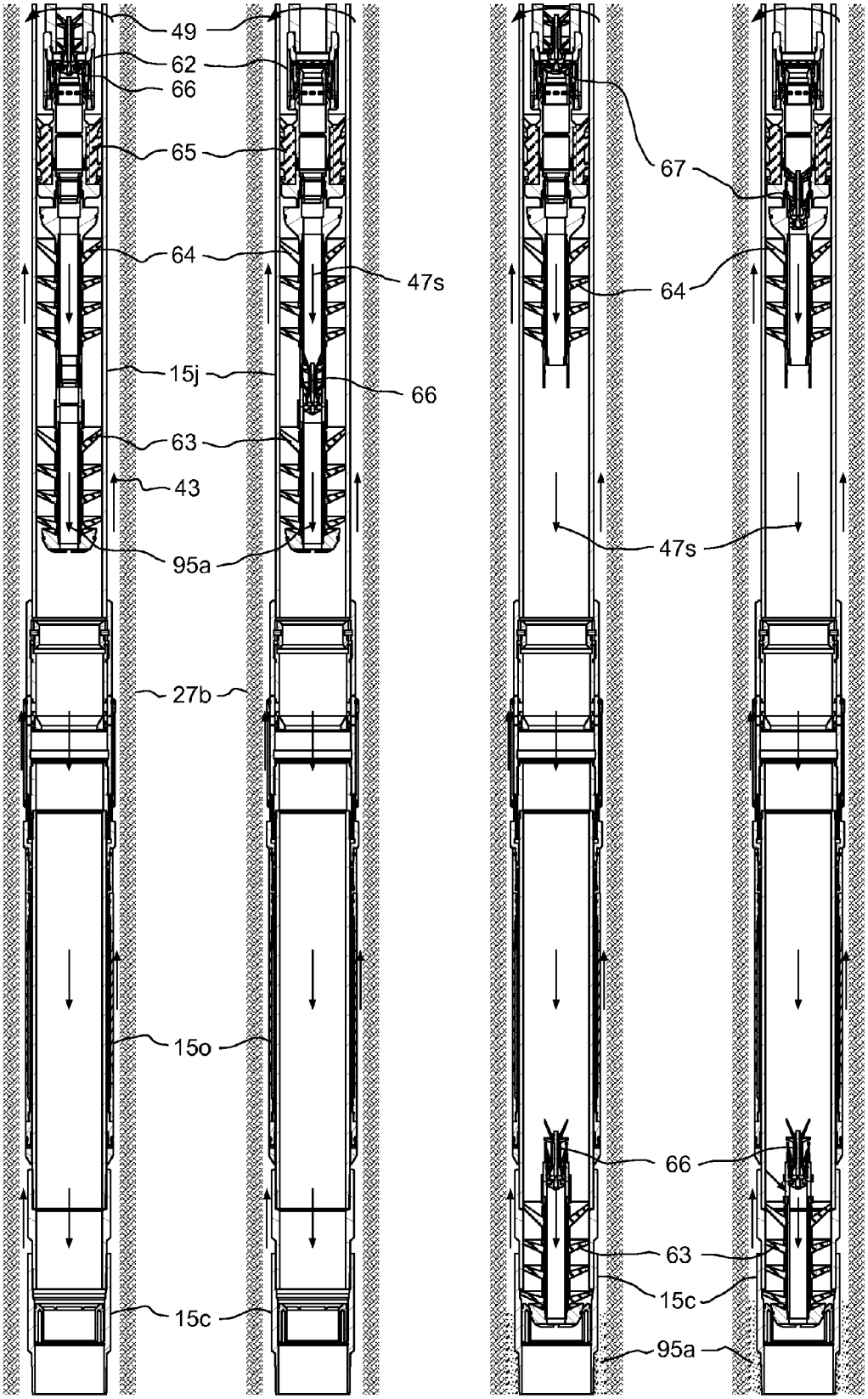
FIGS. 5A-5J illustrate staged cementing of the liner string.

Once the liner string 15 has been advanced into the wellbore 24 by the workstring 9 to a desired deployment depth and the cementing head 7 has been installed, conditioner 43 (FIG. 5A) may be circulated by the cement pump 13 through the valve 41 to prepare for pumping of first stage cement slurry 95*a* (FIG. 5A). The setting plug launcher 7*s* may then be operated and the conditioner 43 may propel the ball 50 down the workstring 9 to the catcher 54. The ball 50 may land in the seat of the catcher 54.

Once the ball 50 has landed continued pumping of the conditioner 43 may increase pressure on the seated ball, thereby also pressurizing the actuation chamber of the actuator 58 and exerting pressure on the actuator piston thereof. The actuator piston may in turn exert a setting force on the PBR 15*r* via the actuator sleeves, a lock sleeve of the latch 61, and the debris barrier 51. The PBR 15*r* may in turn exert the setting force on an upper portion of the liner hanger 15*h* via the packer 15*p*. The liner hanger upper portion may initially be restrained from setting the liner hanger 15*h* by a shearable fastener. Once a first threshold pressure on the actuator piston has been reached, the shearable fastener may fracture, thereby releasing the liner hanger upper portion. The actuator piston, actuator sleeves, lock sleeve, the debris barrier 51, PBR 15*r*, packer 15*p*, and liner hanger upper portion may travel downward until slips of the liner hanger 15*h* are set against the casing 25, thereby halting the movement.

Continued pumping of the conditioner 43 may further pressurize the actuation chamber until a second threshold pressure is reached, thereby fracturing a shearable fastener and releasing the debris barrier 51 from the actuator piston. The liner hanger 15*h* may be restrained from unsetting by a lower ratchet connection. Downward movement of the actuator piston and actuator sleeves may continue until the actuator piston reaches a lower end of the actuation chamber. Continued pumping of the conditioner 43 may further pressurize the LDA bore (above the seated ball 50). An actuation chamber of the running tool 53 may be pressurized and exert pressure on the running tool piston. Once a third threshold pressure on the running tool piston has been reached, a shearable fastener may fracture, thereby releasing the running tool piston. The running tool piston may travel upward, thereby unlocking the running tool 53.

Once the liner hanger 15*h* has been set against an inner surface of a lower portion, such as the bottom, of the casing string 25 and the running tool 53 unlocked, the workstring 9 may be rotated, thereby releasing the floating nut of the running tool from a threaded profile of the liner mandrel 15*m*. The workstring 9 may be raised to verify successful release and lowered to torsionally engage the running tool 53 with the liner string 15 for rotation during the first stage of the cementing operation.

Alternatively, the liner string 15 may be hung from another liner string cemented into the wellbore instead of the casing string 25.

Figure 2:
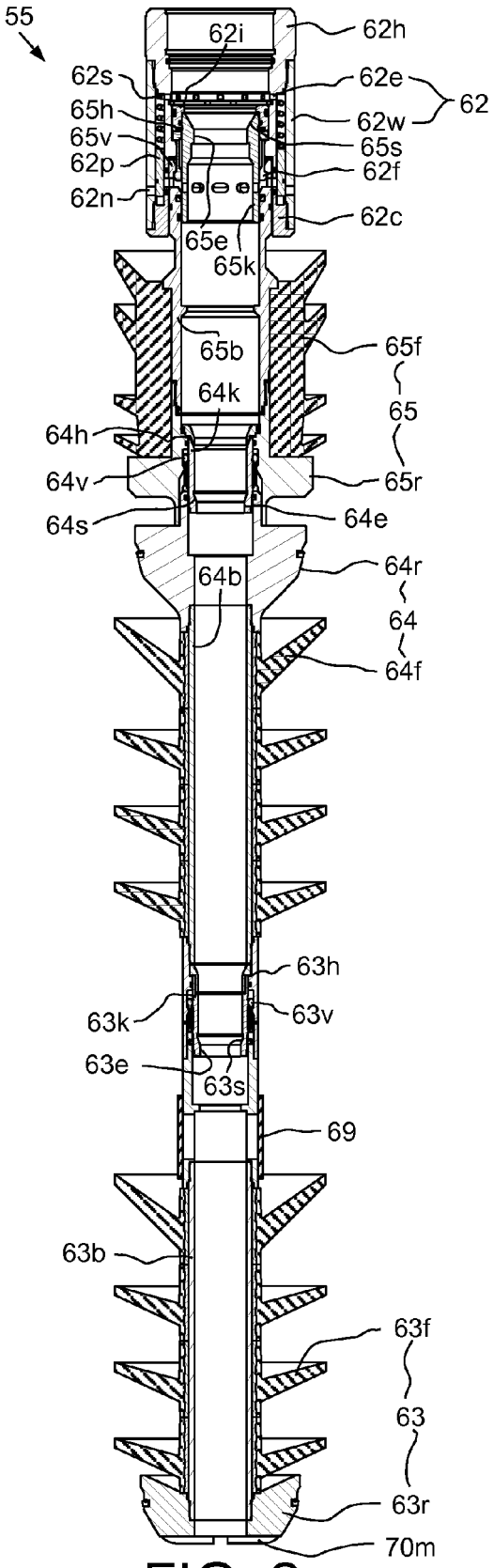
FIG. 2 illustrates a plug release system of a liner deployment assembly of the drilling system.

FIG. 2 illustrates the plug release system 55. The plug release system 55 may include a relief valve 62 and one or more plugs, such as a shutoff plug 63, an opener plug 64, and the closer plug 65. The relief valve 62 may include a housing 62*h*, an outer wall 62*w*, a cap 62*c*, a piston 62*p*, a spring 62*s*, a fastener, such as collet 62*f*, and a seal insert 62*i*. The housing 62*h*, outer wall 62*w*, and cap 62*c* may be interconnected, such as by threaded couplings.

The piston 62*p* and spring 62*s* may be disposed in an annular chamber formed radially between the housing 62*h* and the outer wall 62*w* and longitudinally between a shoulder of the housing and a shoulder of the cap 62*c*. The piston 62*p* may divide the chamber into an upper portion and a lower portion and carry a seal for isolating the portions. The cap 62*c* and housing 62*h* may also carry seals for isolating the portions. The outer wall 62*w* may have one or more (pair shown) inlet ports 62*n* formed therethrough for providing fluid communication between the surge chamber and a lower face of the piston 62*p*. An outlet port may be formed by a gap between a bottom of the housing 62*h* and a top of the cap 62*c*. An equalization port 62*e* may be formed through a wall of the housing 62*h* for providing fluid communication between an upper face of the piston 62*p* and the valve bore.

The piston 62*p* may be longitudinally movable between an upper open position (not shown) and a lower closed position. The spring 62*s* may be disposed between an upper face of the piston 62*p* and an upper end of the chamber, thereby biasing the piston toward the lower closed position. The piston 62*p* may move to the upper open position in response to pressure in the surge chamber being greater than pressure in the valve bore by a pressure differential sufficient to overcome a biasing force of the spring 62*s*. The housing 62*h* and cap 62*c* may each carry a seal straddling the outlet port and the piston 62*p* may be aligned with the outlet port and engaged with the seals in the lower closed position, thereby isolating the outlet port from the inlet ports 62*n*. The piston 62*p* may be clear of the outlet port in the upper open position, thereby allowing fluid communication between the inlet 62*n* and outlet ports.

Alternatively, the spring 62*s* may have a nominal stiffness or be omitted and the valve 62 may function as a check valve instead of a relief valve.

Each plug 63-65 may be made from a drillable material and include a respective finned seal 63*f*-65*f*, a plug body 63*b*-65*b*, a latch sleeve 63*v*-65*v*, a lock sleeve 63*k*-65*k*, and a landing shoulder 63*r*-65*r*. Each latch sleeve 63*v*-65*v* may have a collet formed in an upper end thereof and the closer 65*r* landing shoulder and opener body 64*b* may each have a respective collet profile formed in a lower portion thereof. Each lock sleeve 63*k*-65*k* may have a respective seat 63*s*-65*s* and seal bore 63*e*-65*e* formed therein. Each lock sleeve 63*k*-65*k* may be movable between an upper position and a lower position and be releasably restrained in the upper position by a respective shearable fastener 63*h*-65*h*. The shutoff 63*r* and opener 64*r* landing shoulders may each carry a landing seal. The finned seals 63*f*-65*f* (except for glands) may be made from an elastomer or elastomeric copolymer and the sleeves 63*k,v*-65*k,v*, bodies 63*b*-65*b*, fin glands, and shoulders 63*r*-65*r* may be made from a nonferrous metal or alloy.

The closer shearable fastener 65*h* may releasably connect the closer lock sleeve 65*k* to the valve housing 62*h* and the closer lock sleeve 65*k* may be engaged with the valve collet 62*f* in the upper position, thereby locking the valve collet into engagement with the collet of the closer latch sleeve 65*v*. The opener shearable fastener 64*h* may releasably connect the opener lock sleeve 64*k* to the closer landing shoulder 65*r* and the opener lock sleeve may be engaged with the collet of the opener latch sleeve 64*v*, thereby locking the collet into engagement with the collet profile of the opener landing shoulder. The shutoff shearable fastener 63*h* may releasably connect the shutoff lock sleeve 63*k* to the opener body 64*b* and the shutoff lock sleeve may be engaged with the collet of the shutoff latch sleeve 63*v*, thereby locking the collet into engagement with the collet profile of the opener body.

The shutoff plug 63 may include one or more (pair shown) bypass ports formed through a wall of the shutoff body 63*b* and initially sealed by a burst tube 69 to prevent fluid flow therethrough. The burst tube 69 may be operable to rupture when a predetermined pressure is applied thereto. To facilitate subsequent drill-out, the shutoff landing shoulder 63*r* may have a portion of an auto-orienting torsional profile 70*m,f* formed at a bottom thereof.

Alternatively, the opener landing shoulder 64*r* and/or the closer landing shoulder 65*r* may also have a portion of the auto-orienting torsional profile 70*m,f* formed at a bottom and/or outer surface thereof. Alternatively, the opener plug 64 may also include a one or more (second) bypass ports formed through a wall of the opener body 64*b* and initially sealed by a (second) burst tube to prevent fluid flow therethrough. The second burst tube may be operable to rupture when a predetermined (second) pressure is applied thereto. The second burst tube may be ruptured in the event of failure of the packing stage collar 15*o*.

The landing collar 15*c* may include a housing and a seat disposed therein and connected thereto, such as by threaded couplings. The seat may have longitudinal holes drilled in a wall thereof from a bottom thereof and extending along a length thereof. The holes may terminate adjacent a top of the seat to impart flexibility thereto for receiving the landing shoulder 63*r* of the shutoff plug 63. The seat may have a bore formed therethrough and the other portion 70*f* of the torsional profile 70*m,f* formed in an upper face thereof for engagement with the portion 70*m* of the shutoff plug 63. The seat may also have a seal bore formed therein for receiving the landing seal of the landing shoulder 63*r*.

Figure 3A:
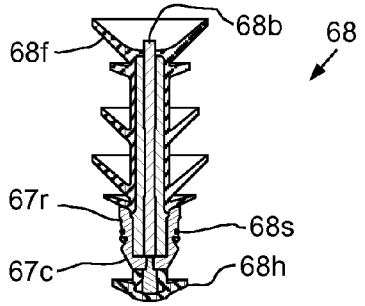
FIGS. 3A-3C illustrate darts for releasing plugs of the plug release system.
Figure 3B:
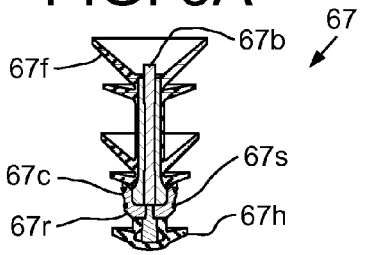
Figure 3C:
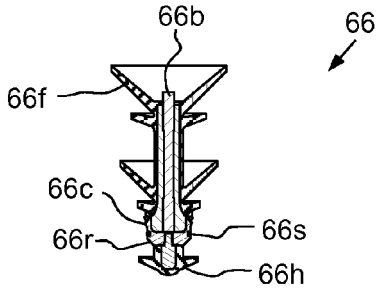

FIGS. 3A-3C illustrate activators, such as darts 66-68, for releasing the respective plugs 63-65. Each dart 66-68 may be made from a drillable material and include a respective finned seal 66*f*-68*f*, dart body 66*b*-68*b*, landing cap 66*c*-68*c*, and retainer head 66*h*-68*h*. Each landing cap 66*c*-68*c* may have a respective landing shoulder 66*r*-68*r* and carry a respective landing seal 66*s*-68*s* for engagement with the respective seat 63*s*-65*s* and seal bore 63*e*-65*e*. A major diameter of the shutoff shoulder 66*r* may be less than a minor diameter of the opener seat 64*s* and a major diameter of the opener shoulder 67*r* may be less than a minor diameter of the closer seat 65*s* such that the shutoff dart 66 may pass through the closer 65 and opener 64 plugs and the opener dart 67 may pass through the closer plug 64. The finned seals 66*f*-68*f* (except for glands) and retainer heads 66*h*-68*h* (except for glands) may be made from an elastomer or elastomeric copolymer and the caps 66*c*-68*c*, bodies 66*b*-68*b*, fin glands, and head glands may be made from a nonferrous metal or alloy.

Alternatively, one or more of the activators may be balls instead of the darts and the balls may be pumped or dropped to the respective plugs.

Figure 4A:
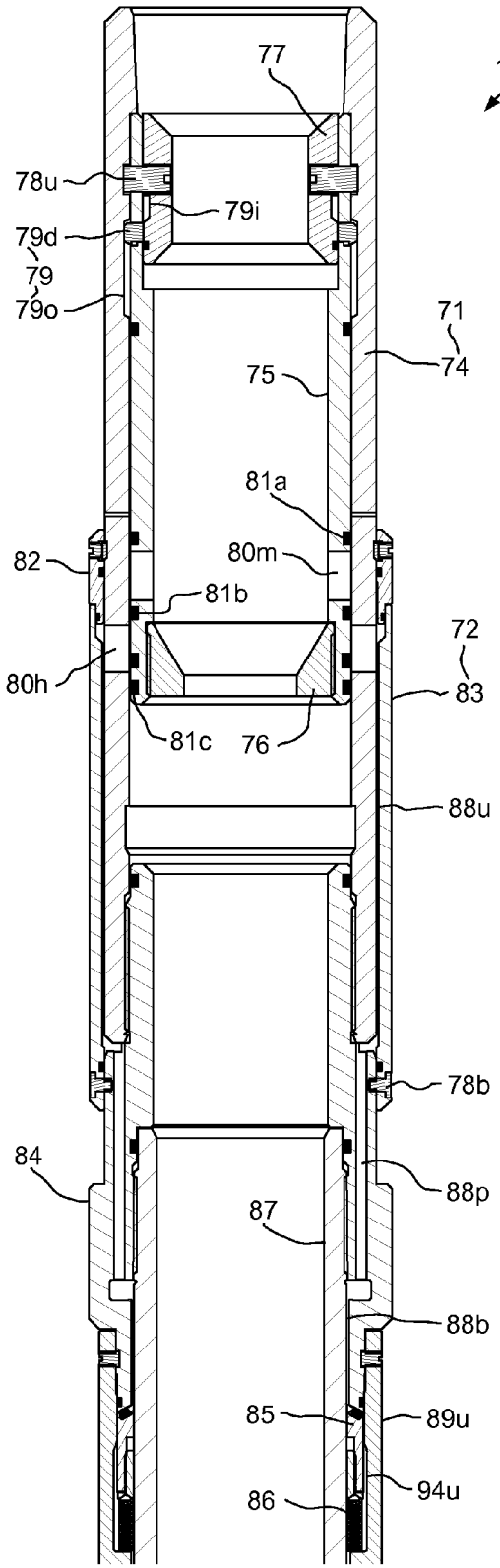
FIGS. 4A and 4B illustrate a packing stage collar of a liner string deployed by the drilling system.
Figure 4B:
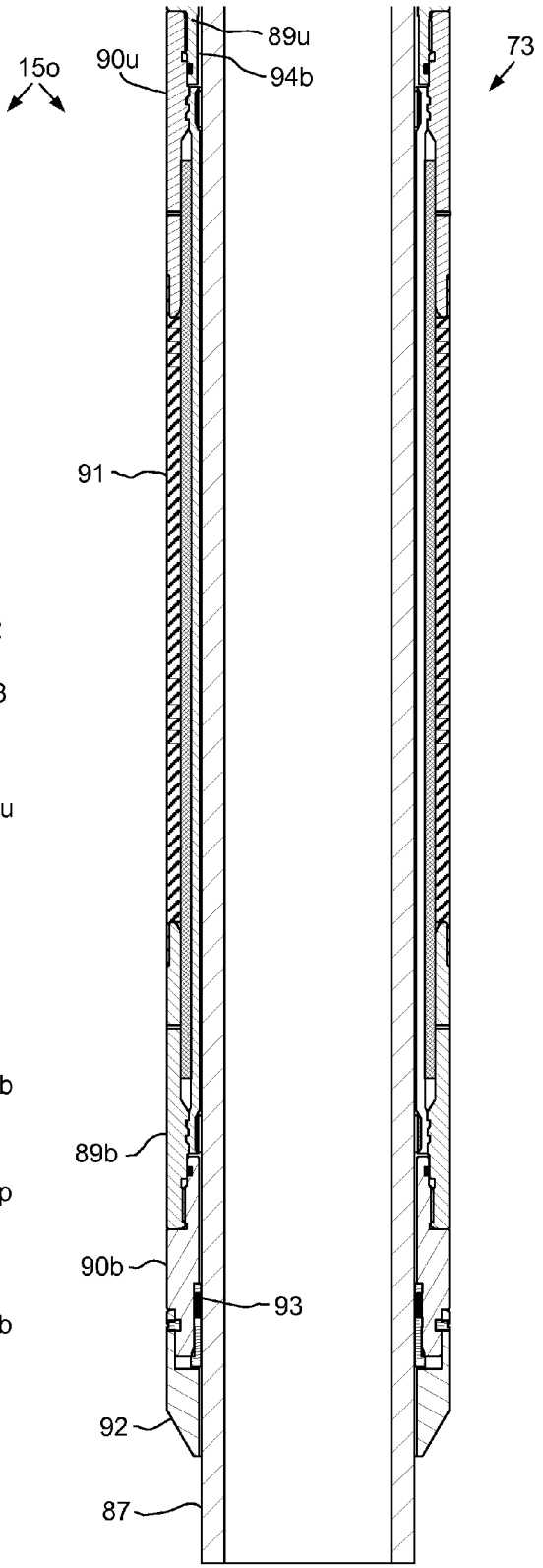

FIGS. 4A and 4B illustrate the packing stage collar 15*o*. The packing stage collar 71 may include a stage valve 71, an inflator 72, and a packer 73. The stage valve 71 may include a housing 74, a sleeve 75, an opener seat 76, and a closer seat 77. The housing 74 may be a tubular member having threaded couplings formed at each longitudinal end thereof for connection to a liner joint 15*j* at an upper end thereof and for connection to the inflator 72 at a lower end thereof. The sleeve 75 may be disposed in the housing 74 and longitudinally movable relative thereto between a deployment (or upper closed) position (shown), an open position (FIG. 5E), and a (lower) closed position (FIG. 5J).

In the deployment position, the closer seat 77 and sleeve 75 may be releasably connected to the housing, such as by one or more (pair shown) shearable fasteners 78*u*. The shearable fasteners 78*u* may each be operable to fracture a first time at an outer interface between the housing 74 and the sleeve 75 in response to engagement of the landing shoulder 64*r* of the opener plug 64 with the opener seat 76, thereby releasing the sleeve 75 and closer seat 77 from the housing 74. The shearable fasteners 78*u* may each be operable to fracture a second time at an inner interface between the closer seat 77 and the sleeve 75 in response to engagement of the landing shoulder 65*r* of the closer plug 65 with the closer seat, thereby releasing the closer seat from the sleeve 75.

A major diameter of the shutoff shoulder 63*r* may be less than a minor diameter of the opener seat 76 and a major diameter of the opener shoulder 64*r* may be less than a minor diameter of the closer seat 77 such that the shutoff plug 63 may pass through the closer 77 and opener 76 seats and the opener plug 64 may pass through the closer seat. The seats 76, 77 may be made from a drillable material, such as a nonferrous metal or alloy.

Figures 5E, 5F, 5G, 5H:
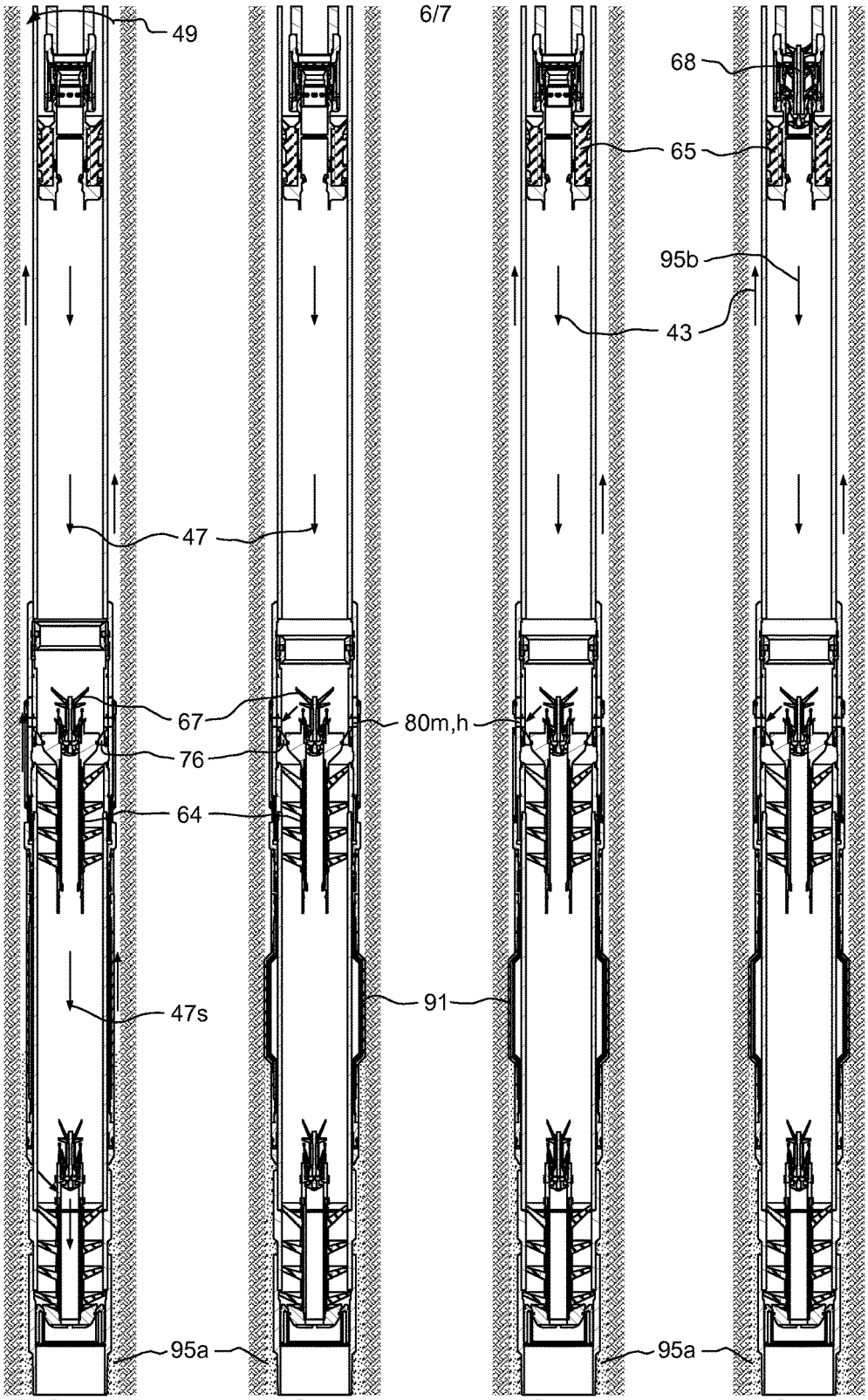
Figures 5I, 5J, 5K:
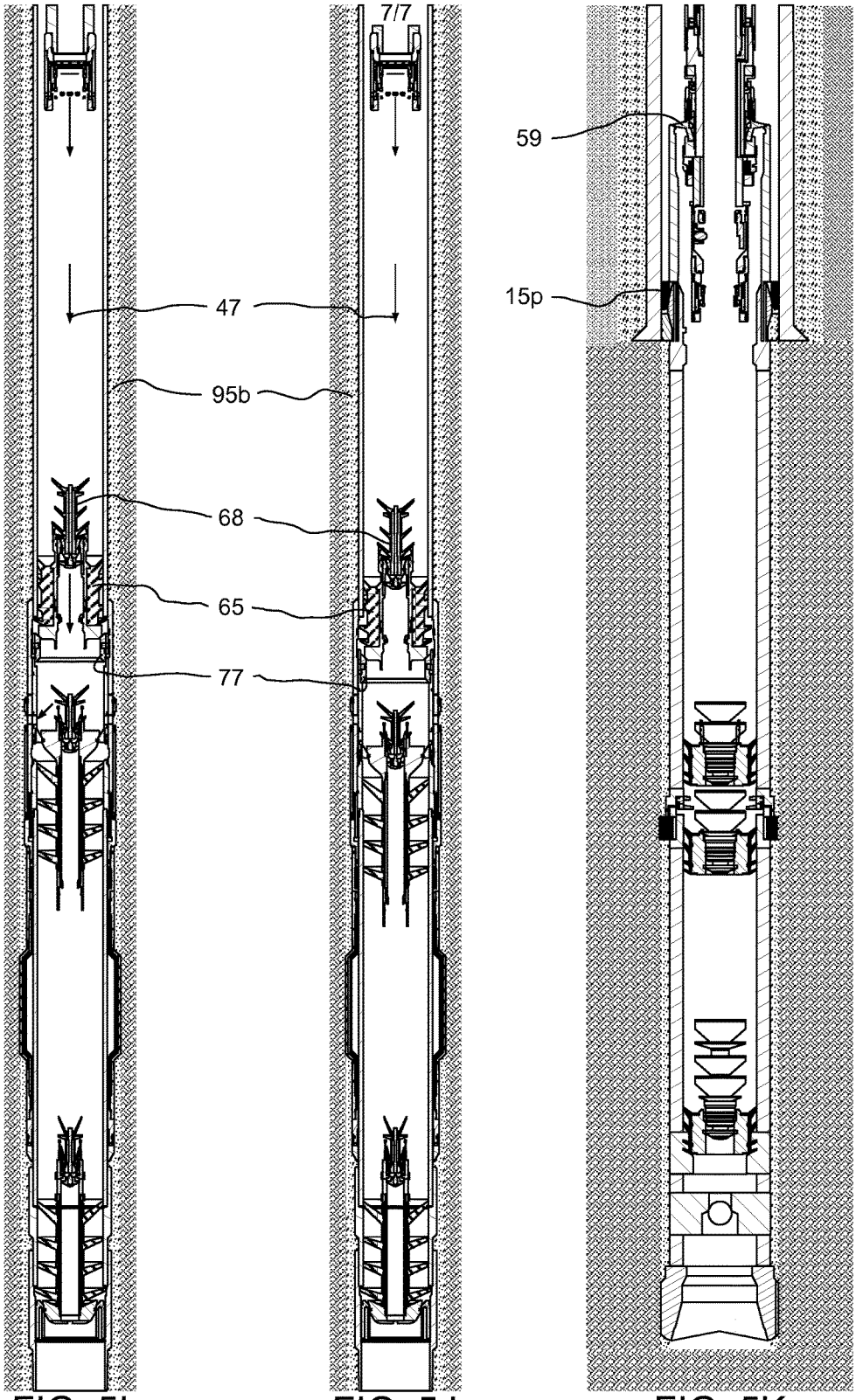
FIG. 5K illustrates setting of a packer of the liner string.

The closer seat 77 may be longitudinally movable relative to the sleeve 75 between an upper lock position (shown) and a lower release position (FIG. 5J). The closer seat 77 may engage a shoulder formed in an inner surface of the sleeve 75 in the release position. The sleeve 75 may also be linked to the housing 74 by a slip joint 79. The slip joint 79 may include one or more (pair shown) slots 790 formed in an inner surface of the housing 74, one or more (pair shown) fasteners, such as dogs 79*d*, and a groove 79*i* formed in an outer surface of the closer seat 77. A (non-grooved) portion of the closer seat outer surface may serve as a locking sleeve of the slip joint 79 when aligned (shown) in the lock position. The dogs 79*d* may be carried in respective sockets formed through a wall of the sleeve 75 and may be radially movable thereto between an extended position (shown) and a retracted position (FIG. 5J). The dogs 79*d* may extend into the respective slots 790 in the extended position, thereby torsionally connecting the sleeve 75 and the housing 74 while allowing relative longitudinal movement therebetween. The dogs 79*d* may be allowed to retract by alignment of the groove 79*i* therewith when the closer seat 77 is in the release position.

The sleeve 75 may have one or more (pair shown) stage ports 80*m* formed through a wall thereof and the housing 74 may have one or more (pair shown) corresponding stage ports 80*h* formed through a wall thereof. The sleeve 75 may carry a pair of seals 81*a,b* straddling the stage ports 80*m* thereof and also carry a lower seal 81*c* adjacent to a lower end thereof for isolating the housing stage ports 80*h* in the deployment position. An outer surface of the sleeve 75 may cover the housing stage ports 80*h* in the deployment and closed positions and the sleeve stage ports 80*m* may be aligned with the housing stage ports in the open position. The closer seat 76 may be connected to the sleeve 75, such as by threaded couplings.

The inflator 72 may include a stop 82, a switch valve 83, a body 84, a check valve 85, one or more (pair shown) biasing members, such as compression springs 86, and an upper portion of a mandrel 87. The stop 82 may be a ring fastened to the housing 74 and sealingly engaged with the switch valve 83, such as by a lap joint. The switch valve 83 may be disposed along an outer surface of the housing 74 and longitudinally movable relative thereto between an upper inflation position (shown) and a lower cementing position (FIG. 5G). In the inflation position, the switch valve 83 may be releasably connected to the housing 74, such as by one or more (pair shown) shearable fasteners 78*b*. In the inflation position, the switch valve 83 may isolate the housing ports 80*h* from fluid communication with the annulus 48 and instead divert fluid flow therefrom down an upper annular gap 88*u* formed between the switch valve and the housing, one or more (pair shown) flow passages 88*p* formed in a wall of the body 84, and a lower annular gap 88*b* formed between the body and the mandrel 87. The fluid may flow down the flow path 88*u,p,b* to the check valve 85. The switch valve 83 may move to the lower cementing position in response to sufficient fluid pressure exerted on a piston shoulder thereof to fracture the shearable fasteners 78*b*. The switch valve 83 may then move downward until a bottom thereof engages a shoulder formed in an outer surface of the valve body 84.

The body 84 may be a tubular member having threaded couplings formed at each longitudinal end thereof for connection to the housing 74 at an upper end thereof and for connection to the mandrel 87 at a mid portion thereof. The mandrel 87 may be a tubular member having threaded couplings formed at each longitudinal end thereof for connection to the body 84 at an upper end thereof and for connection to a liner joint 15*j* at a lower end thereof. A bottom of the body 84 may be beveled for receiving the check valve 85. The check valve 85 may be longitudinally movable relative to the body 84 between a closed position (shown) and an open position (FIG. 5F). The check valve 85 may have a beveled top carrying a seal for closing against the body 84. The springs 86 may be disposed between the check valve 85 and the packer 73 for biasing the check valve toward the closed position. Fluid pressure exerted on the beveled top of the check valve 85 may drive the check valve toward the open position against the springs 86.

The packer 73 may include a lower portion of the mandrel 87, an upper retainer 89*u*, a lower retainer 89*b*, an upper gland 90*u*, a lower gland 90*b*, a bladder 91, a seal keeper 92, and a sliding seal 93. The upper retainer 89*u* may be fastened to the valve body 84 and connected to the upper gland 90*u*, such as by threaded couplings. The bladder 91 may include an outer packing element made from an elastomer or elastomeric copolymer and one or more (two shown) inner layers of reinforcement. Each longitudinal end of the bladder 91 may be molded on or bonded to the respective gland 90*u,b*.

The bladder 91 may extend along an outer surface of the mandrel 87 and be radially displaceable between a deflated position (shown) and an inflated position (FIG. 5F). The bladder 91 may be inflated by fluid flowing down the flow path 88*u,p,b*, through the open check valve 85, and down an upper annular gap 94*u* formed between the check valve 85 and the upper retainer 89*u*, a circumferential space (not shown) formed between the springs 86, and a lower annular gap 94*b* formed between the mandrel 87 and the upper retainer 89*u*. The fluid may flow to an inflation chamber formed between the bladder 91 and the mandrel 87 and exert inflation pressure against the sliding seal 93 isolating an interface formed between the lower retainer 89*b* and the mandrel 87.

FIGS. 5A-5J illustrate staged cementing of the liner string 15. Referring specifically to FIG. 5A, the workstring 9 and liner string 15 (except for the set hanger 15*h*) may be rotated 49 from surface by the top drive 5 and rotation may continue during the cementing operation. Rotation of the rest of the liner string 15 relative to the set hanger 15*h* may be facilitated by a thrust bearing. The first stage cement slurry 95*a* may be pumped from the mixer 42 into the cementing swivel 7*c* via the valve 41*c* by the cement pump 13. The first stage cement slurry 95*a* may flow into the launcher 7*r* and be diverted past the shutoff dart 66 via the diverter and bypass passages.

Once the desired quantity of the first stage cement slurry 95*a* has been pumped, the shutoff dart 66 may be released from the launcher 7*r* by operating the launcher actuator. The desired quantity of the first stage cement slurry 95*a* may correspond to a volume of the annulus 48 between the packing stage collar 15*o* and the reamer shoe 15*s*. Chaser fluid 47 may be pumped into the cementing swivel 7*c* via the valve 41*c* by the cement pump 13. The chaser fluid 47 may flow into the launcher 7*r* and be forced behind the shutoff dart 66 by closing of the bypass passages, thereby propelling the shutoff dart into the workstring bore. Pumping of the chaser fluid 47 by the cement pump 13 may continue until residual cement in the cement line 14 has been purged. Pumping of the chaser fluid 47 may then be transferred to the mud pump 34 by closing the valve 41*c* and opening the valve 6. The shutoff dart 66 and first stage cement slurry 95*a* may be driven through the workstring bore by the chaser fluid 47.

Once a slug 47*s* of chaser fluid 47 has been pumped, a second release plug launcher (not shown) of the cementing head 7 may be operated to launch the opener dart 67. A volume of the slug 47*s* may correspond to, such as being slightly greater than, a volume of the liner string bore between the landing collar 15*c* and the opener seat 76. A train of the opener dart 67, slug 47*s*, shutoff dart 66, and first stage cement slurry 95*a*, may be driven through the workstring bore by the chaser fluid 47.

Referring specifically to FIG. 5B, the shutoff dart 66 may reach the shutoff plug 63 and the landing shoulder 66*r* and seal 66*s* of the dart may engage the seat 63*s* and seal bore

63*e* of the plug. Continued pumping of the chaser fluid 47 may increase pressure in the workstring bore against the seated shutoff dart 66 until a release pressure is achieved, thereby fracturing the shearable fastener 63*h*. The shutoff dart 66 and lock sleeve 63*k* may travel downward until reaching a stop of the shutoff plug 63, thereby freeing the collet of the latch sleeve 63*v* and releasing the plug from the rest of the plug release system 55.

Referring specifically to FIG. 5C, continued pumping of the chaser fluid 47 may drive the first stage cement slurry 95*a* and engaged shutoff dart 66 and plug 63 through the liner bore. The first stage cement slurry 95*a* may be driven downward through the float collar 15*f* and the reamer shoe 15*s* and upward into the annulus 48 until the landing shoulder 63*r* engages the seat of the landing collar 15*c*.

Referring specifically to FIG. 5D, continued pumping of the chaser fluid 47 may increase pressure in the workstring and liner bore against the seated shutoff dart 66 and plug 63 until the rupture pressure is achieved, thereby rupturing the burst tube 69 and opening the bypass ports of the shutoff plug. A portion of the slug 47*s* may flow around the shutoff dart 66 and through the shutoff plug 63, thereby allowing the opener dart 67 to reach the opener plug 64. The landing shoulder 67*r* and seal 67*s* of the opener dart 67 may engage the seat 64*s* and seal bore 64*e* of the opener plug 64. Continued pumping of the chaser fluid 47 may increase pressure in the workstring bore against the seated opener dart 67 until a release pressure is achieved, thereby fracturing the shearable fastener 64*h*. The opener dart 67 and lock sleeve 64*k* may travel downward until reaching a stop of the opener plug 64, thereby freeing the collet of the latch sleeve 64*v* and releasing the plug from the rest of the plug release system 55.

Referring specifically to FIG. 5E, continued pumping of the chaser fluid 47 may drive the engaged opener dart 67 and plug 64 through the liner bore to the packing stage collar 15*o*. The landing shoulder 64*r* and seal thereof may engage the opener seat 76 (and a seal bore thereof) of the packing stage collar 15*o*. Continued pumping of the chaser fluid 47 may increase pressure in the workstring and liner bore against the seated opener plug 64 until a release pressure is achieved, thereby fracturing the shearable fasteners 78*u* at the outer interface. The opener dart 67, plug 64, and seat 76, the sleeve 75, and the closer seat 77 may travel downward until the dogs 79*d* engage a bottom of the slots 790, thereby aligning the sleeve ports 80*m* with the housing ports 80*h*. Rotation 49 of the liner string 15 may then be halted by torsionally disengaging the running tool 53 from the liner string 15 (workstring 9 may then continue to be rotated) or by halting rotation by the top drive 5.

Referring specifically to FIG. 5F, continued pumping of the chaser fluid 47 may open the check valve 85 and inflate the bladder 91 against an exposed wall of the wellbore 24, thereby isolating the first stage cement slurry 95*a* in a lower portion of the annulus 48 from an upper portion of the annulus. The closer dart 68 may be loaded into the launcher 7*r* or the cementing head 7 may have a third launcher.

Referring specifically to FIG. 5G, conditioner 43 may again be circulated by the cement pump 13 through the valve 41 to prepare for pumping of second stage cement slurry 95*b*. As the conditioner is being pumped into the workstring bore, pressure may increase until a release pressure is achieved, thereby fracturing the shearable fasteners 78*b*. The switch valve 83 may travel downward until reaching the stop of the body 84, thereby exposing the housing ports to the upper portion of the annulus 48 and allowing circulation of the conditioner 43 through the annulus upper portion.

Referring specifically to FIG. 5H, the second stage cement slurry 95*b* may be pumped from the mixer 42 into the cementing swivel 7*c* via the valve 41*c* by the cement pump 13. Once the desired quantity of the second stage cement slurry 95*b* has been pumped, the closer dart 68 may be released from the launcher 7*r* by operating the launcher actuator. The closer dart 68 and second stage cement slurry 95*b* may be driven through the workstring bore by the chaser fluid 47. The closer dart 68 may reach the closer plug 65 and the landing shoulder 68*r* and seal 68*s* of the dart may engage the seat 65*s* and seal bore 65*e* of the plug. Continued pumping of the chaser fluid 47 may increase pressure in the workstring bore against the seated closer dart 68 until a release pressure is achieved, thereby fracturing the shearable fastener 65*h*. The closer dart 68 and lock sleeve 65*k* may travel downward until reaching a stop of the closer plug 65, thereby freeing the collet of the latch sleeve 65*v* and releasing the plug from the relief valve 62.

Referring specifically to FIG. 5I, continued pumping of the chaser fluid 47 may drive the engaged closer dart 68 and plug 65 through the liner bore to the packing stage collar 15*o*. The second stage cement slurry 95*b* may be driven through the aligned sleeve 80*m* and housing 80*p* ports into the upper annulus portion and upward through the annulus 48 to the liner hanger 15*h*.

Referring specifically to FIG. 5J, the landing shoulder 65*r* may engage the closer seat 77 and continued pumping of the chaser fluid 47 may increase pressure in the workstring and liner bore against the seated closer plug 65 until a release pressure is achieved, thereby fracturing the shearable fasteners 78*u* at the inner interface. The closer dart 68, plug 65, and seat 77, may travel downward until a bottom of the closer seat 77 engages the sleeve shoulder, thereby freeing the dogs 79*d*. The opener and closer darts 67, 68, plugs 64, 65, and seats 76, 77 and the sleeve 75 may travel downward until a bottom of the sleeve engages a top of the body 84, thereby closing the stage valve 71.

FIG. 5K illustrates setting of the packer 15*p*. The workstring 9 (except for the lock sleeve and debris barrier 51) may be raised until the actuator cylinder top engages the lock sleeve bottom. Continued raising may exert a threshold force to fracture shearable fasteners, thereby releasing the lock sleeve from the debris barrier 51. Continued raising may move the lock sleeve from engagement with dogs of the latch 61 and release the debris barrier 51 from the PBR 15*r*. The raising may continue and torsional profiles of the cylinder and debris barrier may engage. The raising may continue until the packer actuator 59 exits the PBR 15*r*, thereby allowing the dogs thereof to extend and engage the PBR top.

The workstring 9 may be rotated and lowered, thereby exerting weight on the PBR 15*r* via the engaged dogs. The PBR 15*r* may in turn exert the weight on the packer upper portion. A shearable fastener may fracture, thereby releasing the packer upper portion from the liner mandrel 15*m* and expanding the packer 15*p* into engagement with the casing 25. The packer 15*p* may be restrained from unsetting by a ratchet connection. The workstring 9 may then be raised, thereby rotating the debris barrier 51 via the engaged cylinder torsional profile and chaser fluid circulated to ream and wash away any excess second stage cement slurry 95*b*. The workstring 9 may then be retrieved to the MODU 1*m*.

Alternatively, the shutoff dart 66 and plug 63 may be omitted and the lower portion of the annulus 48 not be cemented. This alternative may be especially useful for a lower portion of the liner string 15 being slotted, sand screen, or expandable sand screen instead of solid liner joints 15*j*.

Alternatively, the stage valve 71 may be assembled as part of the liner string 15 without the inflator 72 and packer 73. In this alternative, the first stage cement slurry 95*a* would be allowed to cure before pumping the second stage cement slurry.

Alternatively, the stage valve 71 and a separate packer may be assembled as part of the liner string 15 and the shutoff plug 63 used to inflate the separate packer.

Alternatively, the plug release system 55, darts 66-68, and packing stage collar 15*o* (or any alternatives discussed above) may be used to cement a subsea casing string into the wellbore 24 instead of the liner string 15. The subsea casing string may extend to and be hung from the subsea wellhead 10.

While the foregoing is directed to embodiments of the present disclosure, other and further embodiments of the disclosure may be devised without departing from the basic scope thereof, and the scope of the invention is determined by the claims that follow.

The invention claimed is:

1. A system for cementing a tubular string into a wellbore, comprising:

a packing stage collar as part of a tubular string and having:

a stage valve for assembly having:

a housing, a stage port formed through the housing, a sleeve releasably connected to the housing, wherein the sleeve is movable between a deployment position and an open position, a stage port formed through the sleeve, wherein the stage port of the sleeve is not in fluid communication with the stage port of the housing when the sleeve is in the deployment position, and wherein the stage port of the sleeve is aligned with the stage port of the housing when the sleeve is in the open position, an opener seat connected to the sleeve and configured to move the sleeve from the deployment position to the open position, and a closer seat linked to the sleeve;

a plug release system for operating the stage valve, comprising:

a closer plug having: a body, a finned seal, a latch sleeve, a lock sleeve, and a landing shoulder for engaging the closer seat; and an opener plug having: a body, a finned seal, a latch sleeve, a lock sleeve, and a landing shoulder for engaging the opener seat; and a closer activator for engaging the closer lock sleeve; and an opener activator for engaging the opener lock sleeve;

an inflator connected to the stage valve and having:

an inflation path; and a switch valve disposed about the housing and the stage port formed through the housing and releasablv connected to the housing by a shearable member in an inflation position, the switch valve diverting flow from the stage ports to the inflation path in the inflation position, and wherein the switch valve is movable relative to the housing from the inflation position to a cementation position;

the inflator further having a body;

a first portion of the inflation path is an annular gap between the switch valve and the housing;

a second portion of the inflation path is one or more flow passages through a wall of the body; and a mandrel connected to the body, wherein a third portion of the inflation path is an annular gap between the mandrel and the body;

a packer connected to the inflator and disposed below the stage valve, wherein the packer is in fluid communication with the inflation path.

2. The system of claim 1, wherein each of the activators is a dart.

3. The system of claim 2, wherein:

the system further comprises a landing collar for assembly as part of the tubular string and having a seat, the plug release system further comprises a shutoff plug having a body, a finned seal, a latch sleeve, a lock sleeve, a bypass port formed through the body, a burst tube initially closing the bypass port, and a landing shoulder for engaging the landing collar seat, and the system further comprises a shutoff dart for engaging the shutoff lock sleeve.

4. The system of claim 3, further comprising the lock sleeve of the shutoff plug having a seat formed therein.

5. The system of claim 1, wherein the inflator further comprising:

a check valve disposed along the inflation path, wherein the check valve is movable from an open position to a closed position.

6. The system of claim 5, further comprising:

the packer having a bladder in fluid communication with the inflation path, wherein an inflation chamber in fluid communication with the inflation path is formed between the mandrel and the bladder.

7. The system of claim 6, a biasing member disposed between the check valve and the packer to bias the check valve in the closed position.

8. The system of claim 5, wherein the check valve further comprises a beveled top carrying a seal to seal against the body.

9. The system of claim 1, wherein the plug release system further comprises a valve for providing fluid communication between a bore of the tubular string and a bore of the plug release system in response to pressure in the tubular string bore being greater than pressure in the plug release system bore.

10. The system of claim 1, wherein the sleeve of the stage valve is further movable between the open position and a closed position.

11. The system of claim 10, wherein the sleeve covers the stage port of the housing when in the deployment position.

12. The system of claim 10, wherein the sleeve covers the stage port of the housing in the closed position.

13. The system of claim 1, wherein the closer seat is movable between a lock position and a release position.

14. The system of claim 1, further comprising:

the lock sleeve of the closer plug having a seat formed therein; and the lock sleeve of the opener plug having a seat formed therein.

15. The system of claim 1, further comprising a fastener configured to releasably connect the lock sleeve of the opener plug to the landing shoulder of the closer plug.

16. The system of claim 1, wherein:

the stage valve further comprising a shearable fastener at least partially disposed in the closer seat, sleeve, and housing, wherein the shearable fastener is configured to shear at a first interface between the housing and the sleeve and at a second interface between the closer seat and the sleeve.

17. The system of claim 16, wherein:

at least one dog at least partially disposed in a corresponding slot formed in the housing when the sleeve is in the deployment position.

18. The system of claim 17, wherein:

the at least one dogs are radially movable into a corresponding groove of the closer seat.

* * * * *